United States Patent [19]

Cramb

[11] Patent Number: 4,594,792

[45] Date of Patent: Jun. 17, 1986

[54] DRAWING APPARATUS

[76] Inventor: James C. Cramb, 8 Long Street, Frankston Victoria, Australia, 3199

[21] Appl. No.: 657,819

[22] Filed: Oct. 5, 1984

[30] Foreign Application Priority Data

Oct. 5, 1983 [AU] Australia ..... PG1705/83

[51] Int. Cl.[4] ..... B43L 13/00

[52] U.S. Cl. ..... 33/562; 434/87

[58] Field of Search ..... 33/562, 563, 564, 565; 434/87

[56] References Cited

U.S. PATENT DOCUMENTS

| | | | |
|---|---|---|---|
| 2,570,806 | 10/1951 | Henry | 434/87 |
| 2,950,537 | 8/1960 | Fixen | 434/87 |
| 3,061,946 | 11/1962 | Carty | 434/87 |

FOREIGN PATENT DOCUMENTS

| | | | |
|---|---|---|---|
| 2038843 | 2/1972 | Fed. Rep. of Germany | 33/30 R |
| 2112568 | 10/1972 | Fed. Rep. of Germany | 33/562 |
| 2716285 | 10/1978 | Fed. Rep. of Germany | 33/562 |
| 6411047 | 3/1966 | Netherlands | 434/87 |
| 191484 | 1/1923 | United Kingdom . | |
| 1229753 | 4/1971 | United Kingdom . | |
| 1282348 | 7/1972 | United Kingdom . | |
| 1327070 | 8/1973 | United Kingdom . | |
| 1378115 | 12/1974 | United Kingdom | 33/562 |

*Primary Examiner*—Richard R. Stearns

*Attorney, Agent, or Firm*—Schwartz, Jeffery, Schwaab, Mack, Blumenthal & Evans

[57] ABSTRACT

Drawing apparatus is provided with a series of discs, each disc being located eccentrically and rotatable within another disc. The discs may be provided with cut-outs to enable shapes to be drawn on paper on which the drawing apparatus is placed. The perimeters of the discs are provided with reference points to enable the relative positions of one disc within another to be recorded, so that reproduction of patterns is possible by reference to the recordings of the relative positions.

6 Claims, 4 Drawing Figures

DRAWING APPARATUS

The present invention relates to drawing apparatus adapted for use in the production of patterns and which may be used as an aid for children's drawings.

The drawing apparatus of the present invention provides a means whereby patterns may be readily devised and drawn on paper or other suitable material and whereby children and adults may be encouraged to use their imagination in the development of a variety of designs, patterns and shapes.

According to the broad aspect of the present invention, there is provided at least one disc adapted to be rotated or moved over a sheet of material, such as paper, relative to reference frame, said disc having at least one cut-out therein whereby at least a part of the profile of the cut-out may be used as a guide about which a pencil or other suitable marking instrument may be traced thereby forming part of the pattern to be produced on the sheet material.

The perimeter of the disc may be marked with a number of regular divisions. By aligning a marked division with a set external point and rotating the disc about its centre through one or more divisions a series of regular trace lines may be produced. The disc may be rotated about a central pin or rotated within a frame work supporting the perimeter of the disc.

In order to achieve a wide variety of trace lines and/or shapes, the disc may be adapted to rotate relative to another rotatable or fixed disc or discs, or to slide or otherwise move along a straight or curved line. Similarly the shape of the cut-out and its position within the disc may be varied, and/or several interchangeable discs may be provided. Additionally an insert, incorporating a cut-out, may be introduced to fit within the disc in a specific or varied location.

The edges of the disc(s) may be smooth, notched, serrated and/or bevelled in order to assist in guidance between mating surfaces and/or to minimize unwanted movement between parts of the apparatus during the drawing of trace lines.

Suitable markings on the parts of the apparatus and identification of specific cut-outs will enable a particular set of trace lines to be repeated.

While plastic, either clear or opaque, is the preferred material for the discs, other materials such as fibre-glass, lino tiles, metal and wood may be used.

But in order that the invention may be more clearly understood, reference will now be made to the accompanying drawings, wherein.

Figure 1A:
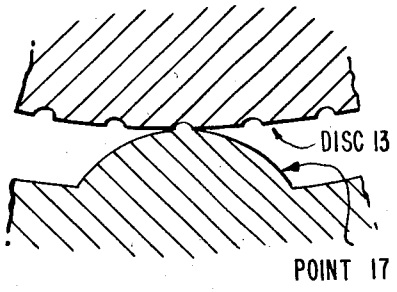
FIG. 1A is an enlargement of the area shown in circle A of FIG. 1.
Figure 1:
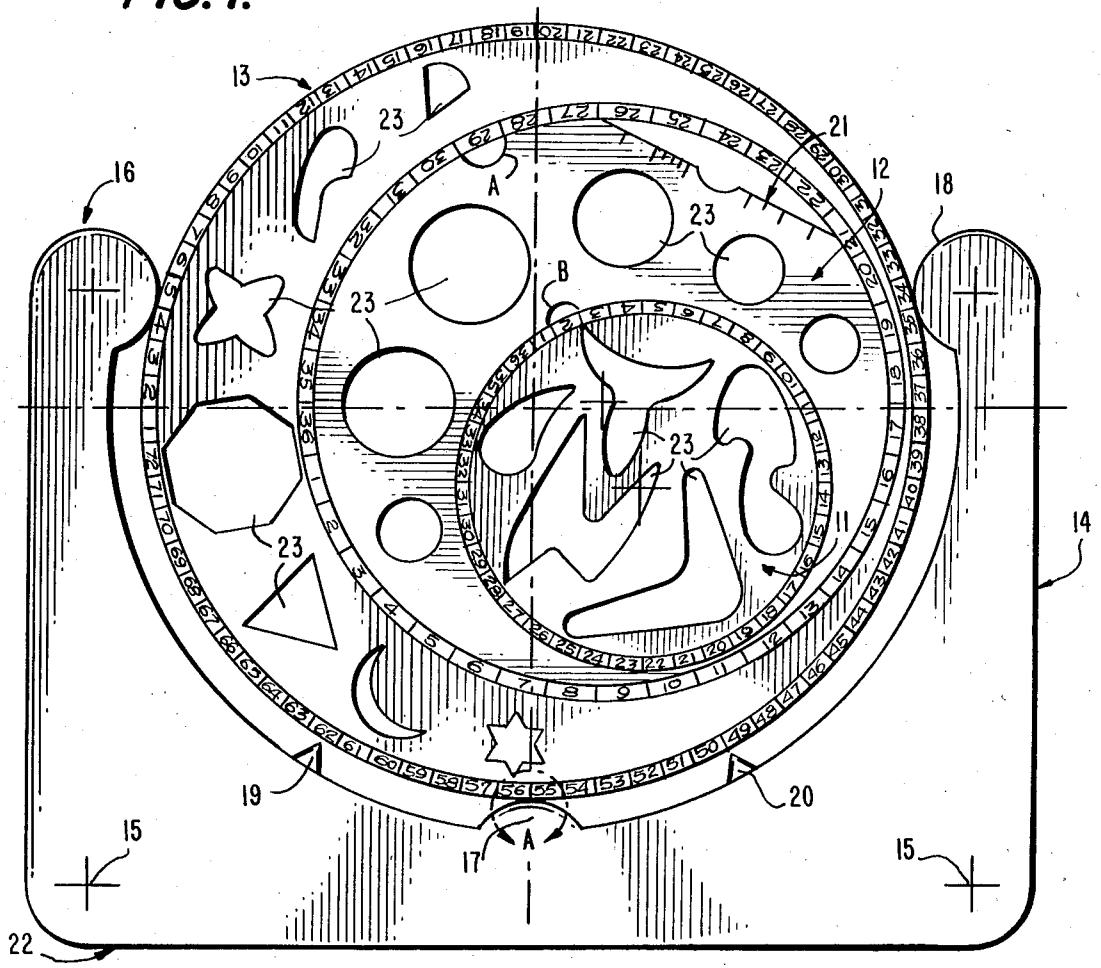
FIG. 1 shows one embodiment of the drawing apparatus of the present invention.

The drawing apparatus of FIG. 1 comprises three discs 11, 12 and 13. Disc 11 is able to rotate within an eccentric circular cut-out in disc 12 and likewise disc 12 is able to rotate within an eccentric circular cut-out in disc 13.

Disc 13 rotates within a U-shaped frame 14. The frame may be fixed to a sheet of paper or like material, possibly.

The frame makes contact with disc 13 at three points 16, 17 and 18. The distance between points 16 and 18 is such that they exert a pressure or disc 13 forcing it to have firm contact with point 17. The U-shape frame thus acts with a spring-loaded pincer action on disc 13.

Disc 13 and point 17 may be so designed to enable point 17 to engage in one of several equi-spaced grooves incorporated around the edge of disc 13. After movement of disc 13 through a number of divisions, the assembly will remain stable with point 17 engaged in a particular groove. (Ref. FIG. 1*a*)

The face of disc 13 has equi-spaced lines marked around its outer perimeter adjacent to the grooves around the edge as previously described, the divisional space between the lines being allotted a specific numeric character. In addition frame 14 is provided with two pointers 19 and 20.

Pointer 20 aligns with one of the divisional marks around disc 13 and enables accurate indexing of disc 13 whilst pointer 19 aligns with a specific section of disc 13 to enable initial location and/or recording of the position of disc 13 relative to frame 14.

Disc 11 has similar markings around the face of its perimeter and likewise has the eccentric circular cut-out in disc 13.

Disc 12 has an indentation cut out on its outer perimeter at "A" and a similar indentation cut out on its inner perimeter at "B".

Indentation "A" enables relative positioning of disc 12 with disc 13 and indentation "B" enables relative positioning of disc 12 with disc 11.

Disc 12 also has a flat chord 21 on its outer perimeter, said chord allowing the disc to be slid along the outer straight sides 22 of the frame.

A number of cut-out shapes 23, may be provided in one or any of the discs 11, 12, 13 (as shown in FIG. 1).

By use of the various markings on the three discs and the pointers on the frame, provision is made to determine the relative locations of the three discs relative to each other and to the outer frame.

Thus it is possible to provide a means of recording an initialarrangement of the apparatus prior to drawing a design and recording of the various movements during the development of a specific design. The recordings provide the means of repeating a specific design. A sequential list of recordings could be considered as the unique "code" for a specific design.

Figure 2:
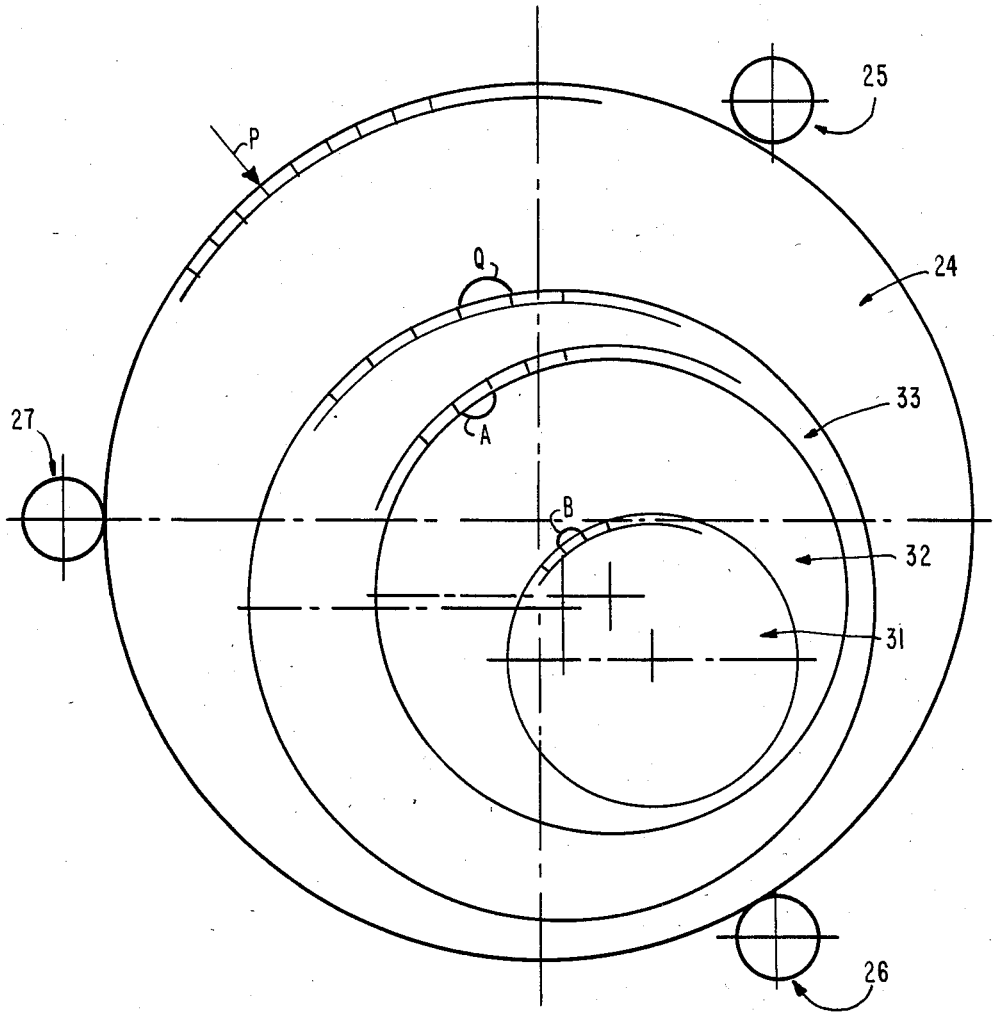
FIG. 2 is a second embodiment of the invention.

In the embodiment shown in FIG. 2, the other frame 14 is replaced by a fourth disc 24, supporting the three disc set 31, 32, 33 eccentrically therein. Disc 24 is in turn supported, for rotation on the backing paper, by three wheels 25, 26, 27 pinned to the support at their centres.

Although not fully detailed in FIG. 2, discs 31, 32 and 33 are provided with index markings and cut-out shapes as described for discs 11, 12 and 13. Likewise disc 24 has cut-out shapes and index markings around its perimeter to be aligned against any external point "P" for indexing purposes. The eccentric circular cut-out in disc 24 has an indentation "Q" cut out on its inner perimeter. The markings on disc 33 align with indentation Q for recording of location and indexing purposes.

By trading around selected cut out and then rotating it sequentially through a selected number of movements and tracing the cut-out between each movement, it is possible to achieve a multitude of outlines, representing decorative designs and/or graphic representations of solid forms of varying shapes and sizes.

To achieve a mirror image of a specific design the complete disc assembly should be turned over.

Linear designs are achieved by sliding the chord section 21 along the outer edge 22 of the frame 13, the edge 22 being suitably marked to provide accurate indexing.

The mating surfaces of the discs may be bevelled, serrated or toothed so that unwanted movement between relative parts is avoided during the drawing of a design. The teeth may not be continuous on one of the mating surfaces, but instead replaced by a series of nodes, sufficient to retain the two parts together without slipping and allow desired relative measured movement.

The design of the discs should allow for clearance (approx. 0.25 mm) between the underside of the disc and the paper around the perimeter of the cut-out shape. This will avoid smudging of wet ink or paint or the like during the drawing of a design.

The actual shape of the cut-out section may be regular —such as a triangle, hexagon, rhombus, star, circular, elliptical—or may be irregular, either symmetrical or nonsymmetrical. In the case of non-symmetrical cut-outs, it will be apparent that inversion of the part bearing that cut-out yields yet another shape. By appropriate selection of the index points and so spacing of the shape tracings, a variety of complex shapes and solids may be drawn.

Thus for children, the drawing apparatus in addition to providing the means whereby a large number of intricate shapes or patterns can be reproduced, also provides the possibility of learning how solids may be evolved or developed from flat shapes.

To produce a pattern on a piece of paper, the frame 14 or disc 24 with their inserted discs 11, 12, 13 or 31, 32, 33 respectively, are placed over the paper and a particular cut-out section selected as the pattern basis. By appropriate rotation of the various parts within the frame 14 or disc 24 (or/and rotating disc 24) and tracing of the cut-out section, either completely or in part, at each rotation point, the desired pattern can be achieved.

The actual drawing implements used to trace or transfer the pattern from the cut-out section to the paper can vary from pens, pencils, ball-point pens and the like, dependent on the age and skill of the user. Further a variety of colours may be used to emphasize the pattern.

Thus it will be apparent that the present invention provides drawing apparatus readily adapted to produce a large variety of patterns. As an educational toy, it provides a challenge to children and helps develop their imagination and "sense" of geometry or spatial concepts. As an instrument the drawing apparatus can be used in reproducing patterns for fabric design, screen-printing, wall paper design, and used in a range of "Arts and Crafts", such as Leatherwork, Pottery, Ceramics, Marquetry, Glass Engraving, Copper Art, Wood Carving, Wall Hangings, Applique, Decupage, Embroidery, Tapestry, Needle point work, Cake Decorating, China Painting, Rug Making.

It is proposed that a computer program be provided with the drawing apparatus such that a design developed with the apparatus may be readily repeated by use of a computer either via a "VDU" or a suitable graphics printer.

Input commands to the computer will be in accordance with the "Recordings" made during the development of the design with the apparatus. Alternatively a design may be developed on the "VDU" and subsequently drawn with the drawing apparatus using instructions indicated by the computer, the instructions being a series of rotations or other movements of the various discs relative to each other and an external fixed point.

The use of the computer enables designs to be stored in a very convenient manner and also enables speed in producing or comparing specific designs.

Figure 3:
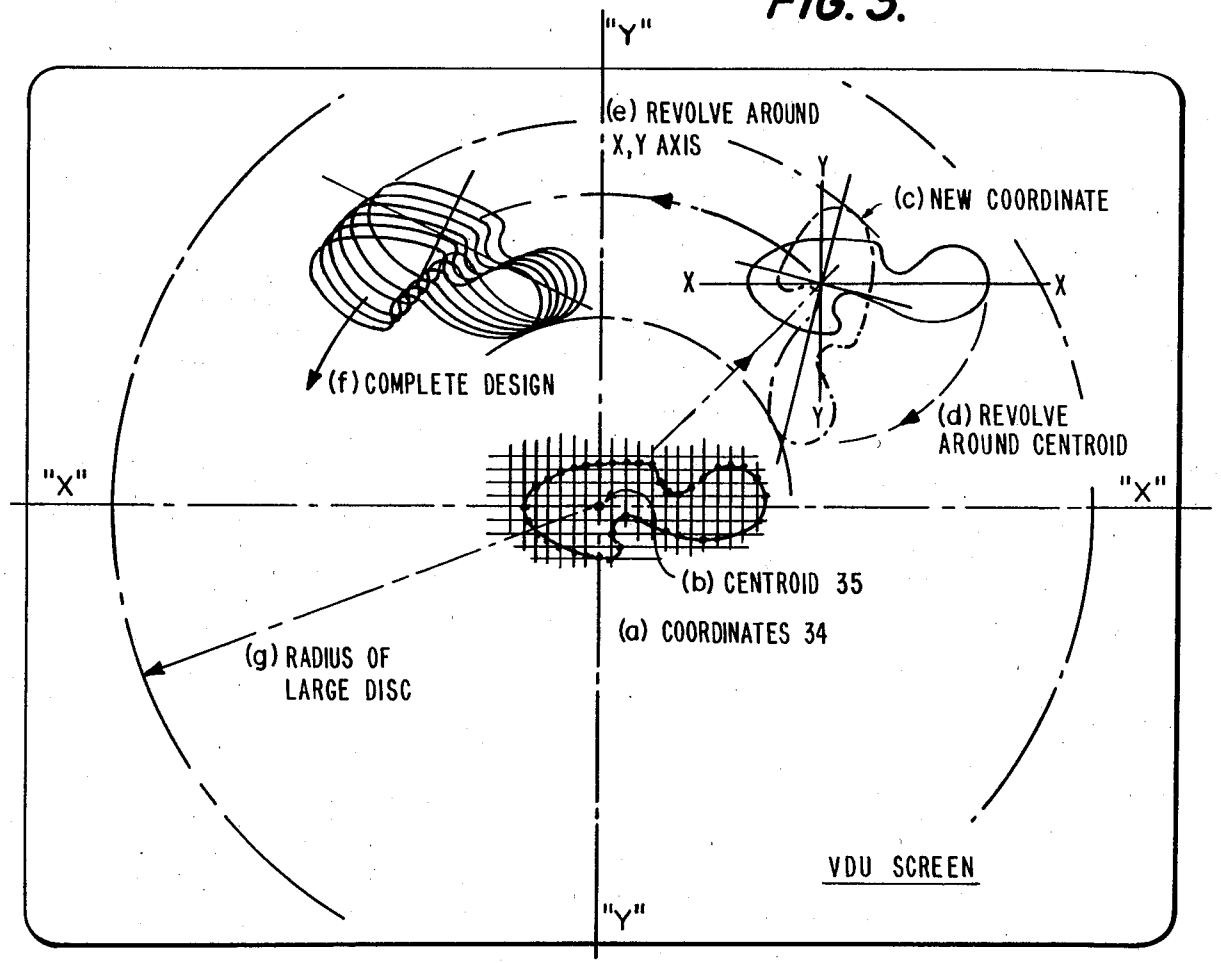
FIG. 3 shows the invention as applied to a video display unit (VDU).

Regarding the computer program the outline of a specific cut-out within the drawing apparatus will be represented by a continuous series of co-ordinates 34 located about the intersection of two axes at right angles to each other, to be called the X and Y axes (FIG. 3). The intersection of the axes is called the centroid 35. Likewise the VDU screen will display an X and Y axes centrally positioned (FIG. 3). Initially the centroid 35*a* of a selected shape will correspond with the intersection of the X and Y axes on screen, and its axis will align with the X and Y axes on the VDU.

By a series of commands the centroid of a shape may be directed to new co-ordinates Xc and Yc relative to the X & Y axes. The shape may now be revolved about its centroid 35*c* to a new position (shown in dotted line). Once a desired position had been achieved the shape may be shown as a trace outline on the VDU represented by its unique series of coordinates as at D. Further commands may now rotate the shape radially about the X and Y axes of the VDU screen to a new position and again trace outlines are produced on the VDU at E. The procedure continued until the desired design has been achieved as at F. At this point the computer program should be able to describe the achieved design in terms of the unique "code" as previously described so that the design may be reproduceced with the drawing instrument. It should be noted that the intersection of the X and Y axes of the VDU screen represents the center point of the large disc. The centre points of the other discs will be displayed on the VDU in an appropriate manner to enable rotation of the shape about these points if physically possible.

The extension of the apparatus by the inclusion of a computer program encourages the use of home computers and highlights the realisation that computers are but a tool to be manipulated to provide desired results—possibly in this case providing adults with a better understanding and acceptance of computers and removing them from the area of "new" and "too hard to understand" science, a problem faced by many adults today.

Thus the present invention provides drawing apparatus of a versatile nature with appeal to both children and adults, and incorporating educational or training qualities to both amuse and educate the user.

I claim:

1. Drawing apparatus comprising at least three discs of increasing diameter, each of said disc being located eccentrically within the disc next in diametrical size and mounted for rotation therein, the diameter of each disc being greater than the radius of the disc next in diametrical size, said discs being mounted for rotation over a sheet of material relative to a reference frame, and at least the smallest disc having at least one cut-out therein, whereby rotation of the disc enables the cut-out to be infinitely repositioned both angularly and radially within the limits of the apparatus, at least part of the profile of the cut-out being used as a guide about which a marking instrument may be traced to thereby form a pattern on the sheet of material.

2. Drawing apparatus as claimed in claim 1 wherein the number of discs exceeds three.

3. Drawing apparatus as claimed in claim 1 wherein said discs are provided with peripheral markings to act as reference points to preset the angular and radial position of the cut-out.

4. Drawing apparatus as claimed in claim 1 wherein the second smallest disc has a straight edge incorporated on its perimeter whereby said second smallest disc, together with the smallest disc eccentrically located therein, can be removed from the apparatus and oriented so that said straight edge can be placed in contact with another straight edge to enable linear designs to be produced by the cut-out.

5. Drawing apparatus as claimed in claim 1, wherein cut-outs are formed in each of said discs.

6. Drawing apparatus as claimed in claim 1, further including a frame surrounding the disc of greatest diameter, and means for retaining such disc in said frame.

* * * * *